United States Patent [19]

Kitao et al.

[11] Patent Number: 4,746,645

[45] Date of Patent: May 24, 1988

[54] HEAT-SENSITIVE RECORDING MATERIAL

[75] Inventors: Teijiro Kitao, Tondabayashi; Mitsuru Kondo, Hyogo; Toshitake Suzuki, Kobe; Masayuki Omatsu, Nishinomiya; Hironori Fujii, Sennan; Kenji Minami, Sennan, all of Japan

[73] Assignees: Kanzaki Paper Manufacturing Company, Limited, Tokyo; Sugai Chemical Industry Co., Ltd., Wakayama, both of Japan

[21] Appl. No.: 942,400

[22] Filed: Dec. 16, 1986

[30] Foreign Application Priority Data

Dec. 24, 1985 [JP] Japan ..... 60-290974

[51] Int. Cl.[4] ..... B41M 5/18

[52] U.S. Cl. ..... 503/210; 427/150; 503/211; 503/212; 503/216; 503/225

[58] Field of Search ..... 346/216, 217, 218; 427/150, 151, 152; 503/210-212, 216, 217, 225

[56] References Cited

U.S. PATENT DOCUMENTS

| | | | |
|---|---|---|---|
| 3,911,171 | 10/1975 | Janssens et al. | 427/150 |
| 4,498,091 | 2/1985 | Yamato et al. | 427/150 |
| 4,503,446 | 3/1985 | Yahagi et al. | 346/216 |
| 4,540,999 | 9/1985 | Arai | 346/217 |
| 4,590,500 | 5/1986 | Satake et al. | 346/216 |

*Primary Examiner*—Bruce H. Hess

*Attorney, Agent, or Firm*—Larson and Taylor

[57] ABSTRACT

Disclosed is a heat-sensitive recording material comprising a base sheet and a heat-sensitive record layer formed over the base sheet and comprising a colorless or pale-colored basic dye and a color developing material capable of forming a color when contacted with the dye, the heat-sensitive recording material being characterized in that the heat-sensitive record layer contains as the color developing material at least one multi-valent metal salt of a halophthalic acid derivative represented by the formula (I)

wherein R represents a divalent saturated or unsaturated $C_2$–$C_{12}$ aliphatic hydrocarbon group which may optionally have a hydroxyl, $C_1$–$C_3$ acyloxy or phenyl group as a substituent or a divalent saturated or unsaturated $C_4$–$C_6$ aliphatic hydrocarbon group containing one or two ether bonds, X is a halogen atom and n is an integer of 1–4.

6 Claims, No Drawings

HEAT-SENSITIVE RECORDING MATERIAL

This invention relates to heat-sensitive recording materials, and more particularly to heat-sensitive recording materials which are outstanding in high-speed recording and in colorfastness and having an unrecorded portion (background portion) less susceptible to the reduction of whiteness, and which therefore can maintain the record image with stability.

Heat-sensitive recording materials are well known which are adapted to produce record images by thermally contacting a colorless or pale-colored basic dye with an organic or inorganic color developing material.

With recent remarkable progress in thermal recording systems, high-speed recording systems have become available. For example, thermal facsimile systems produce a copy of A4 size within 20 seconds, and thermal printers achieve a recording speed of at least 120 characters per second. For use with such high-speed recording systems, there is a demand for heat-sensitive recording materials suitable for use in high-speed recording.

On the other hand, these heat-sensitive recording materials are being used in various manners with the rapidly increasing use of thermal facsimiles, thermal printers and the like, and thus are more frequently stored as contacted with plastics film or as laid over other record media such as diazo copying paper (diazotype paper). However, when a heat-sensitive recording material suited to high-speed recording is stored in contact with plastics film, the record image is markedly prone to fade or disappear. When the heat-sensitive recording material is stored in contact with diazo copying paper, particularly such paper subjected to copying operation immediately before contact, the white background portion of the recording material significantly tends to undergo the coloring (fogging) due to the action of the diazo developer and lose its whiteness. At present, it is strongly desired to remedy the foregoing drawbacks of the heat-sensitive recording materials for high-speed recording.

An object of the present invention is to provide heat-sensitive recording materials satisfactorily suitable for high-speed recording.

Another object of the invention is to provide heat-sensitive recording materials which, even stored in contact with plastics film, can retain the record image without marked fading.

Another object of the invention is to provide heat-sensitive recording materials which, even in contact with a diazo developer on the diazo copying paper, are not subject to the fading of the record images or the fogging of the background portion.

These objects and other features of the present invention will become more apparent from the following description.

This invention provides heat-sensitive recording materials comprising a base sheet and a heat-sensitive record layer formed over the base sheet and comprising a colorless or pale-colored basic dye and a color developing material capable of forming a color when contacted with the dye, the heat-sensitive recording material being characterized in that the heat-sensitive record layer contains as the color developing material at least one multi-valent metal salt of a halophthalic acid derivative represented by the formula

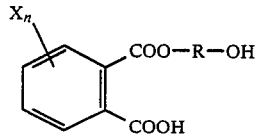

(I)

wherein R represents a divalent saturated or unsaturated $C_2$–$C_{12}$ aliphatic hydrocarbon group which may optionally have a hydroxyl, $C_1$–$C_3$ acyloxy or phenyl group as a substituent or a divalent saturated or unsaturated $C_4$–$C_6$ aliphatic hydrocarbon group containing one or two ether bonds, X is a halogen atom and n is an integer of 1–4.

We conducted extensive research to overcome the foregoing drawbacks of conventional heat-sensitive recording materials for high-speed recording and found that the fading of record images and fogging of background portion are caused by the interaction between the color developing material of the heat-sensitive recording material and the plasticizer contained in the plastic film or the solvent component present in the developer of the diazo copying paper, particularly a mixture of ethylene glycol and its oligomers (e.g., diethylene glycol, triethylene glycol, etc.). We carried out investigations on a color developing material which would not be affected by such plasticizer or by the solvent component. Our investigations have revealed that the heat-sensitive recording materials prepared by using the foregoing multi-valent metal salt of a halophthalic acid derivative of the formula (I) as the color developing material not only have high sensitivity and are suitable for use in high-speed recording but also have excellent resistance to the plasticizer and diazo developer. We have accomplished the present invention based on this novel finding.

The heat-sensitive recording materials of the present invention are rendered suited to high-speed recording due to the use of the multi-valent salt of the compound of the formula (I). Furthermore, the recording materials of the invention exhibit such high resistance to the plasticizer that they are substantially free from the fading of the record image even when stored as contacted with plastic film. They also exhibit such high resistance to the developer of diazo copying paper that they do not pose the problem of marked reduction in the whiteness of the background portion even when stored in contact with diazo copying paper immediately after copying operation.

It remains to be clarified why the multi-valent metal salt of the compound of the formula (I) can make heat-sensitive recording materials suitable for high-speed recording and resistant to a plasticizer and diazo developer. One of the factors which improve the above properties of the recording materials is presumably that the multi-valent metal salts of the compounds of the formula (I) are sparingly soluble in the plasticizer or in the solvent component present in diazo developer.

The multi-valent metals for forming the salts of the compound of the formula (I) may include various metals having a valency of 2 or more, preferably 2 or 3, and particularly include magnesium, calcium, barium, zinc, aluminum, tin, iron, cobalt, nickel and the like. Of these metals, magnesium, calcium, barium, zinc, tin, iron, cobalt and nickel are divalent and aluminum is trivalent. Iron can also be trivalent.

Specific examples of the multi-valent metal salts of the compound of the formula (I) are magnesium salts, calcium salts, barium salts, zinc salts, aluminum salts, tin salts, iron salts, cobalt salts or nickel salts, of the halophthalic acid derivatives represented by the following formulas.
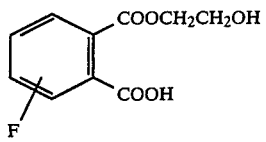
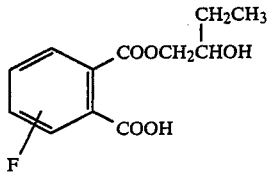
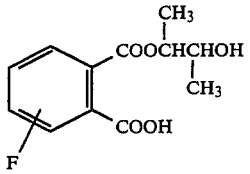
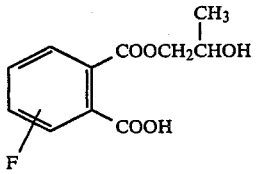
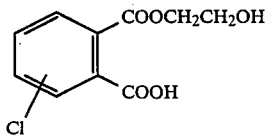
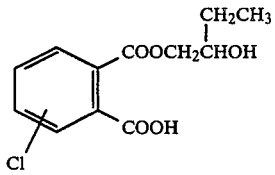
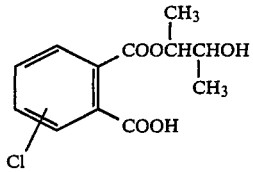
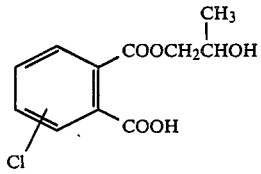
-continued
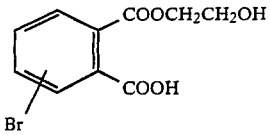
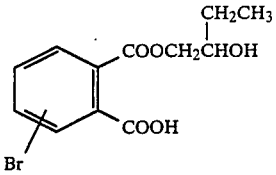
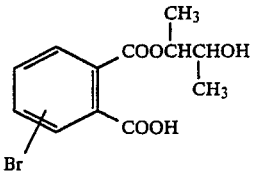
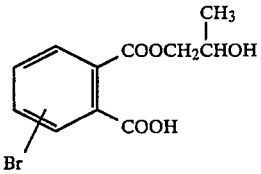
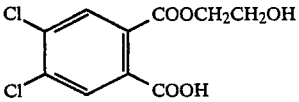
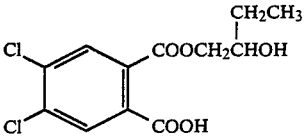
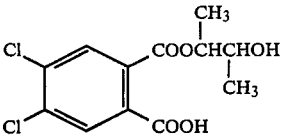
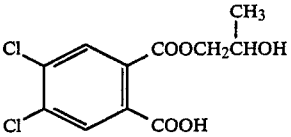
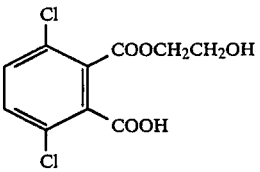
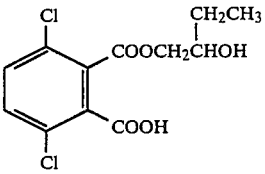

-continued
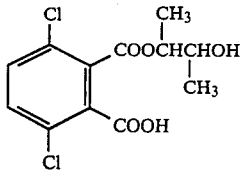
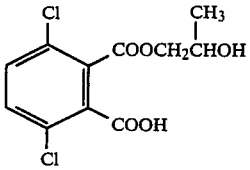
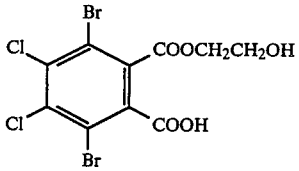
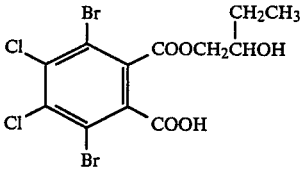
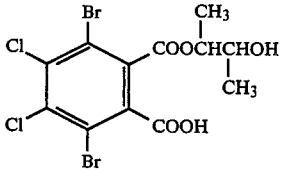
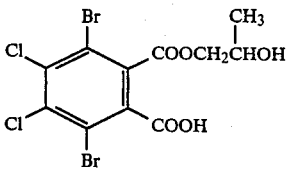
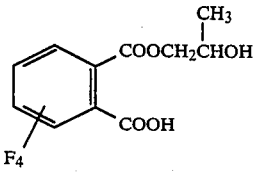
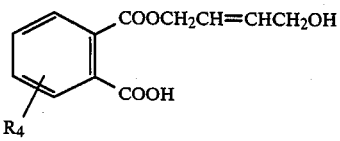
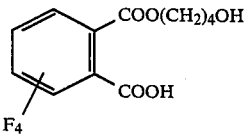
-continued
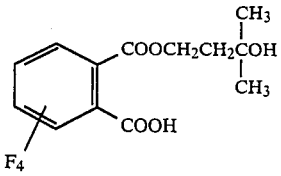
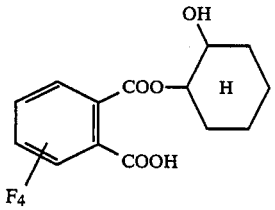
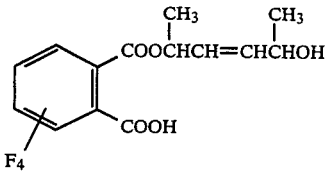
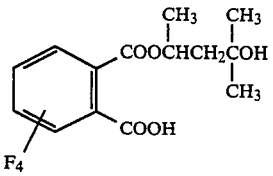
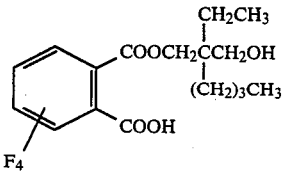
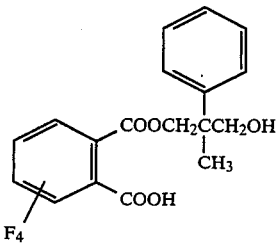
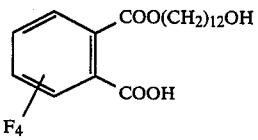
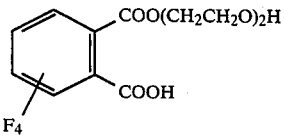

-continued
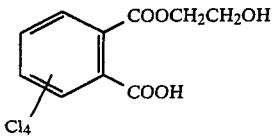
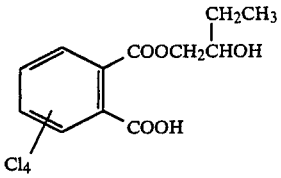
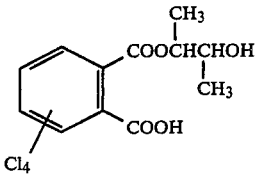
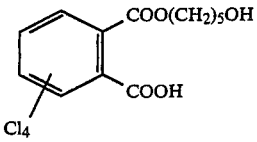
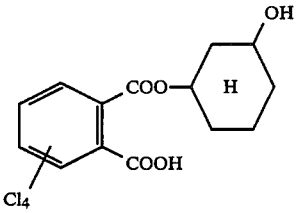
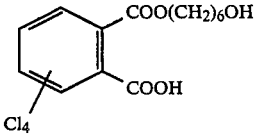
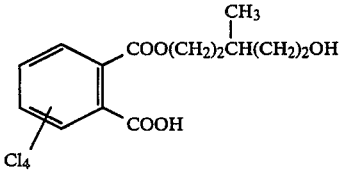
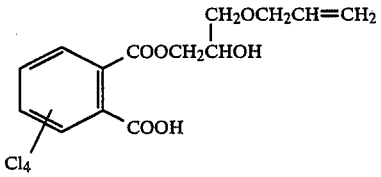
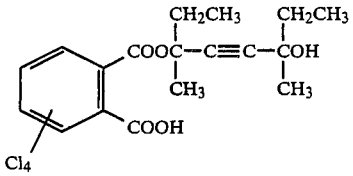
-continued
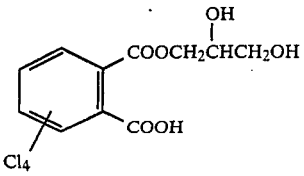
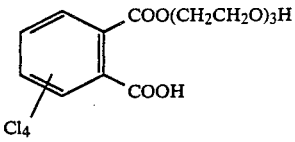
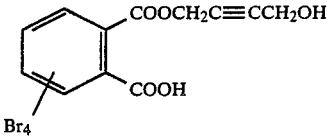
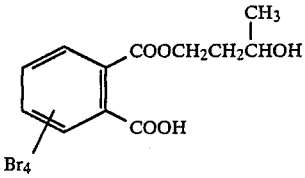
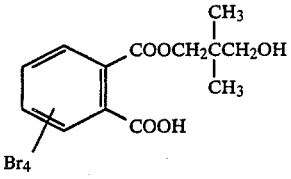
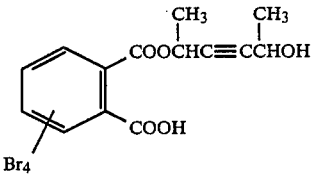
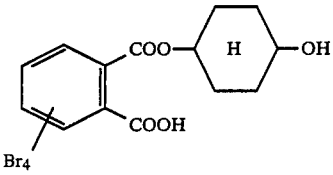
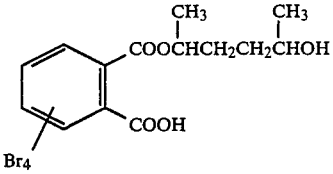
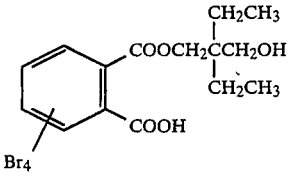

-continued

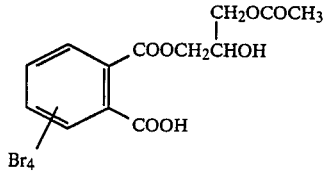

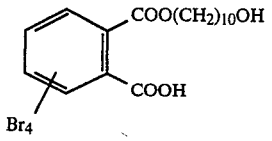

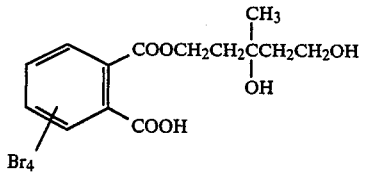

These compounds can be used singly or at least two of them are usable in admixture.

Of the multi-valent metal salts of the halophthalic acid derivatives of the formula (I), multi-valent metal salts of the compound of the following formula (II) are preferred since they can exhibit excellent color forming properties.

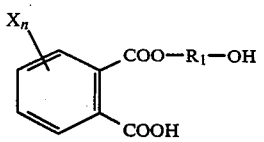

(II)

wherein $R_1$ is a divalent saturated $C_2$–$C_6$ aliphatic hydrocarbon group which may optionally have a hydroxyl group or acetoxy group as a substituent or a divalent saturated $C_4$–$C_6$ aliphatic hydrocarbon group containing one or two ether bonds, X is a halogen atom and n is an integer of 1 to 4.

Of the foregoing multi-valent metal salts, it is preferable to use magnesium, calcium, barium or zinc salts of tetrahalophthalic acid derivative, i.e., the compounds of the formula (I) or (II) wherein n is an integer of 4, since the use of these preferable salts can afford heat-sensitive recording materials having excellent recording properties, especially excellent image retentivity and is also economically advantageous.

It is more preferable to use a zinc, calcium, magnesium or barium salt of a compound of the formula

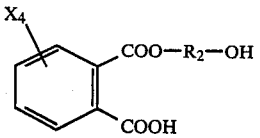

(III)

wherein $R_2$ is a branched- or straight-chain $C_2$–$C_6$ alkylene group which may optionally have a hydroxyl group or acetoxy group as a substituent, cyclohexylene group or a group $—CH_2CH_2OCH_2CH_2—$, and X is fluorine, chlorine or bromine atom since the use of these compounds usually achieves better results.

The multi-valent metal salts of the halophthalic acid derivatives of the formula (I) are generally known or can be prepared according to various known methods, for example, by reacting the corresponding halophthalic anhydride with the corresponding alcohol of the formula $$HO—R—OH \quad \text{(Ia)}$$

wherein R is as defined above in the presence or absence of an inert solvent and subjecting the resulting monoester to a salt forming reaction in a conventional manner.

Examples of useful colorless or pale-colored basic dyes which can be used to form the heat-sensitive record layer for the present heat-sensitive recording materials include those heretofore known as given below.

Triarylmethane-based dyes, e.g. 3,3-bis(p-dimethylaminophenyl)-6-dimethylaminophthalide, 3,3-bis(p-dimethylaminophenyl)phthalide, 3-(p-dimethylaminophenyl)-3-(1,2-dimethylindol-3-yl)phthalide, 3-(p-dimethylaminophenyl)-3-(2-methylindol-3-yl)phthalide, 3,3-bis(1,2- -dimethylindol-3-yl)-5-dimethylaminophthalide, 3,3-bis(1,2-dimethylindol-3-yl)-6-dimethylaminophthalide, 3,3-bis(9-ethylcarbazol-3-yl)-6-dimethylaminophthalide, 3,3-bis(2-phenylindol-3-yl)-6-dimethylaminophthalide, 3-p-dimethyl -aminophenyl-3-(1-methylpyrrol-3-yl)-6-dimethylaminophthalide, etc.

Diphenylmethane-based dyes, e.g., 4,4'-bisdimethylaminobenzhydryl benzyl ether, N-halophenylleucoauramine, N-2,4,5-trichlorophenyl-leucoauramine, etc.

Thiazine-based dyes, e.g., benzoyl-leucomethyleneblue, p-nitrobenzoyl-leucomethyleneblue, etc.

Spiro-based dyes, e.g., 3-methyl-spiro-dinaphthopyran, 3-ethyl-spiro-dinaphthopyran, 3-phenylspiro-dinaphthopyran, 3-benzyl-spiro-dinaphthopyran, 3-methyl-naphtho-(6'-methoxybenzo)spiropyran, 3-propylspiro-dibenzopyran, etc.

Lactam-based dyes, e.g., rhodamine-B-anilinolactam, rhodamine-(p-nitroanilino)lactam, rhodamine-(o-chloroanilino)lactam, etc.

Fluoran-based dyes, e.g., 3-dimethylamino-7-methoxyfluoran, 3-diethylamino-6-methoxyfluoran, 3-diethylamino-7-methoxyfluoran, 3-diethylamino-7-chlorofluoran, 3-diethylamino-6-methyl-7-chlorofluoran, 3-diethylamino- 6,7-dimethylfluoran, 3-(N-ethyl-p-toluidino)-7-methylfluoran, 3-diethylamino-7-(N-acetyl-N-methylamino)fluoran, 3-diethylamino-7-N-methylaminofluoran, 3-diethylamino-7-dibenzylaminofluoran, 3-diethylamino-7-(N-methylN-benzylamino)-fluoran, 3-diethylamino-7-(N-chloroethyl-N-methylamino)fluoran, 3-diethylamino-7-N-diethylaminofluoran, 3-(N-ethyl-p-toluidino)-6-methyl-7-phenylaminofluoran, 3-(N-ethyl-p-toluidino)-6-methyl-7-(p-toluidino)fluoran, 3-diethylamino-6-methyl-7-phenylaminofluoran, 3-dibutylamino-6-methyl-7-phenylaminofluoran, 3-diethylamino-7-(2-carbomethoxyphenylamino)fluoran, 3-(N-ethyl-N-isoamyl-)amino-6-methyl-7-phenylaminofluoran, 3-(N-cyclohexyl-N-methylamino)-6-methyl-7-phenylaminofluoran, 3-pyrrolidino-6-methyl-7-phenylaminofluoran, 3-piperidino-6-methyl-7-phenylaminofluoran, 3-diethylamino-6-methyl-7 3-diethylamino-7-(o-chlorophenylamino)fluoran, 3-dibutylamino-7-(o-chlorophenylamino)fluoran, 3-pyrrolidino-6-methyl-7-p-butylphenylaminofluoran, 3-(N-methyl-N-n-amyl-)amino-6-methyl-7-phenylaminofluoran, 3-(N-ethyl-N-n-amyl)amino-6-methyl-7-phenylaminofluoran, 3-(N-methyl-N-n-hexyl)amino-6-methyl-7-phenylaminofluoran, 3-(N-ethyl-N-n-hexyl)amino-6-methyl-7-phenylaminofluoran, 3-(N-ethyl-N-β-ethylhexyl-)amino-6-methyl-7-phenylaminofluoran, etc.

The basic dyes useful in this invention are not limited to those exemplified above, and at least two of them can be used in admixture.

There is no specific restriction on the ratio of the basic dye and the color developing material i.e., the multi-valent metal salt of the compound of the formula (I) having the above-specified structure. Generally about 30 to about 500 parts, preferably about 100 to about 300 parts, by weight of the color developing material is used per 100 parts by weight of the basic dye.

These materials are formulated into a coating composition for a heat-sensitive record layer generally with use of water as a dispersion medium and with use of a stirring or pulverizing device such as a ball mill, attritor or sand mill, by dispersing the materials at the same time or separately.

Usually the coating composition has incorporated therein a binder such as starches, hydroxyethyl cellulose, methyl cellulose, carboxymethyl cellulose, gelatin, casein, gum arabic, polyvinyl alcohol, styrene-maleic anhydride copolymer salt, styrene-acrylic acid copolymer salt, styrene-butadiene copolymer emulsion and the like. The amount of the binder used is about 10 to about 40% by weight, preferably about 15 to about 30% by weight, based on the weight of the total solids content of the composition.

Various auxiliary agents can be included in the coating composition. Examples of useful auxiliary agents are dispersants such as sodium dioctylsulfosuccinate, sodium dodecylbenzenesulfonate, sodium lauryl sulfate and fatty acid metallic salts, ultra-violet absorbers of the triazole or like type, defoaming agents, fluorescent dyes, coloring dyes, etc. A dispersion or emulsion of stearic acid, polyethylene, carnauba wax, paraffin wax, zinc stearate, calcium stearate, ester wax or the like can be incorporated in the coating composition in order to prevent the heat-sensitive recording material from sticking to the recording machine or thermal recording head on its contact therewith.

Insofar as the desired results of the present invention are not impaired, other additives can be contained in the coating composition. Examples of the additives are various known thermally fusible materials, e.g., fatty acid amides such as stearic acid amide, stearic acid methylenebisamide, oleic acid amide, palmitic acid amide and coconut fatty acid amide, hindered phenols such as 2,2'-methylene-bis(4-methyl-6-tert-butylphenol) and 1,1,3-tris(2-methyl-4-hydroxy-5-tert-butylphenyl)butane, ethers such as 1,2-bis(phenoxy)ethane, 1,2-bis(4-methylphenoxy)ethane, 1,2-bis(3-methylphenoxy)ethane and naphthalene-2 benzyl ether, esters such as dibenzyl terephthalate and phenyl ester of 1-hydroxy-2-naphthoic acid, etc. The amount of these thermally fusible materials, when used, is not particularly limited, but is preferably about 100 to about 500 parts by weight per 100 parts by weight of the basic dye.

An inorganic pigment such as kaolin, clay, talc, calcium carbonate, calcined clay, titanium oxide, diatomaceous earth, fine granular anhydrous silica, activated clay and the like can be added to the coating composition in order to eliminate or reduce the tendency for the residue to be piled on the thermal recording head.

Although the present invention has an important feature of using the specific metal salt of a halophthalic acid derivative of the formula (I) as the color developing material, the coating composition can incorporate conventional phenol-type color developing materials such as 4,4'-isopropylidene diphenol (bisphenol A), 4,4'-cyclohexylidene diphenol, benzyl p-hydroxybenzoate, dimethyl 4-hydroxyphthalate, etc., insofar as these conventional color developing materials do not deteriorate the results contemplated by this invention.

Base sheets which can be used for the present heat-sensitive recording materials include paper, plastics film, synthetic fiber sheet, etc. among which paper is most preferred in terms of costs, adequacy for coating, etc. The amount of the coating composition to be applied to the base sheet to form a record layer thereon is not particularly limited, but is generally about 2 to about 12 g/m$^2$, preferably about 3 to about 10 g/m$^2$, based on the dry weight. Furthermore, an overcoat can be formed over the record layer to protect the layer. It is also possible to apply a protective coat to the rear side of the base sheet or to apply an undercoat between the record layer and the base sheet. Various other technologies known in the art are applicable to the present invention.

The heat-sensitive recording materials thus prepared are suitable for high-speed recording, eliminate the tendency to fade the images and to fog the background portion and involve lesser amounts of residue piled on the thermal recording head.

The present invention will be described below in more detail with reference to examples to which, however, this invention is in no way limited. In the examples and comparative examples that follow, the parts and percentages are all by weight unless otherwise specified.

EXAMPLE 1

(1) Preparation of mixture A 3-(N-Cyclohexyl-N-methylamino)-6-methyl-7-phenylaminofluoran: 10 parts
Stearic acid amide 20 parts
5% Aqueous solution of methyl cellulose: 15 parts
Water: 120 parts The above mixture was pulverized by a sand mill to a mean particle size of 3 μm.

(2) Preparation of mixture B

Zinc salt of 3,4,5,6-tetra-chlorophthalic acid mono-2-hydroxyethyl ester: 30 parts
5% Aqueous solution of methyl cellulose: 30 parts
Water: 70 parts The above mixture was pulverized by a sand mill to a mean particle size of 3 μm.

(3) Formation of record layer

One hundred and sixty-five parts of the mixture A, 130 parts of the mixture B, 30 parts of silicon oxide pigment (oil absorption 180 ml/100 g), 150 parts of a 20% aqueous solution of oxidized starch and 55 parts of water were mixed together and agitated to obtain a coating composition. The composition was applied to non-coated paper weighing 50 g/m$^2$ in an amount of 7.5 g/m$^2$ based on dry weight, and dried to give a heat-sensitive recording paper.

EXAMPLES 2–15

Fourteen kinds of heat-sensitive recording papers were prepared in the same manner as in Example 1 except that the multi-valent metal salts of the halophthalic acid derivatives listed in Table 1 below were used in place of the zinc salt of 3,4,5,6-tetrachlorophthalic acid mono-2-hydroxyethyl ester used for preparing the mixture B.

EXAMPLE 16

A heat-sensitive recording paper was prepared in the same manner as in Example 1 except that 20 parts of 1-hydroxy-2-naphthoic acid phenyl ester was used in place of 20 parts of the stearic acid amide used for the preparation of the mixture A and that 30 parts of zinc salt of 3,4,5,6-tetrachlorophthalic acid mono-2,3-dihydroxypropyl ester was used in place of 30 parts of the zinc salt of 3,4,5,6-tetrachlorophthalic acid mono-2-hydroxyethyl ester used for the preparation of the mixture B.

COMPARATIVE EXAMPLES 1–4

Four kinds of heat-sensitive recording papers were prepared in the same manner as in Example 1 except that the compounds listed in Table 1 below were used in place of the zinc salt of 3,4,5,6-tetrachlorophthalic acid mono-2-hydroxyethyl ester used for the preparation of the mixture B.

The 20 kinds of the heat-sensitive recording papers prepared above were caused to form images thereon with use of a thermal facsimile (Model HIFAX-700, product of Hitachi, Ltd., Japan), and the color density ($D_0$) of the record image was measured by a Macbeth reflection densitometer (Model RD-100R, product of Macbeth Corp., U.S. using amber filter). Table 1 below shows the results.

The heat-sensitive recording materials after recording were superposed on a vinyl chloride film so that the recorded portion was kept in contact with the film. After 5 hours, the color density ($D_1$) of the record image was measured by the same reflection densitometer. Table 1 below shows the results.

The whiteness of the record layer of the heat-sensitive recording materials before recording was determined by a Hunter multipurpose reflectometer (product of Toyo Seiki Seisakusho, Japan) and then a sheet of non-coated paper impregnated with a diazo developer (SD type, product of Ricoh Co., Ltd., Japan) was superposed on the heat-sensitive recording material. After they were left to stand in this state for 5 minutes, the whiteness of the record layer was measured in the same manner as above with the results as indicated below in Table 1.

TABLE 1

| Ex. | Color developing material | Color density ($D_0$) | Color density after test for plasticizer resistance ($D_1$) | Whiteness before recording (%) | Whiteness after test for diazo resistance (%) |
|---|---|---|---|---|---|
| 1 | Zinc salt of 3,4,5,6-tetrachlorophthalic acid mono-2-hydroxyethyl ester | 1.33 | 1.24 | 82.7 | 82.4 |
| 2 | Calcium salt of 3,4,5,6-tetrachlorophthalic acid mono-2-hydroxyethyl ester | 1.29 | 1.15 | 82.6 | 82.1 |
| 3 | Magnesium salt of 3,4,5,6-tetrachlorophthalic acid mono-2-hydroxyethyl ester | 1.27 | 1.14 | 82.3 | 82.0 |
| 4 | Zinc salt of 3,4,5,6-tetrachlorophthalic acid mono-3-hydroxypropyl ester | 1.32 | 1.20 | 82.3 | 81.8 |
| 5 | Zinc salt of 3,4,5,6-tetrachlorophthalic acid mono-3-hydroxy-2,2-dimethylpropyl ester | 1.33 | 1.23 | 82.6 | 82.3 |
| 6 | Zinc salt of 3,4,5,6-tetrachlorophthalic acid mono-3-hydroxybutyl ester | 1.32 | 1.19 | 82.4 | 81.9 |
| 7 | Zinc salt of 3,4,5,6-tetrachlorophthalic acid mono-2-hydroxypropyl ester | 1.33 | 1.24 | 82.7 | 82.4 |
| 8 | Zinc salt of 3,4,5,6-tetrachlorophthalic acid mono-2-hydroxybutyl ester | 1.32 | 1.23 | 82.6 | 82.2 |
| 9 | Zinc salt of 3,4,5,6-tetrachlorophthalic acid mono-2-hydroxy-3-acetoxypropyl ester | 1.33 | 1.23 | 82.7 | 82.3 |
| 10 | Zinc salt of 3,4,5,6-tetrachlorophthalic acid mono-4-hydroxycyclohexyl ester | 1.32 | 1.10 | 82.2 | 81.1 |
| 11 | Zinc salt of 3,4,5,6-tetrachlorophthalic acid mono-2-(β-hydroxyethoxy)ethyl ester | 1.31 | 1.12 | 82.4 | 82.0 |
| 12 | Zinc salt of 3,4,5,6-tetrabromophthalic acid mono-2-hydroxyethyl ester | 1.30 | 1.08 | 82.5 | 82.4 |
| 13 | Zinc salt of 3,4,5,6-tetrafluorophthalic acid mono-2-hydroxyethyl ester | 1.33 | 1.25 | 82.0 | 81.9 |
| 14 | Zinc salt of 4,5-dichlorophthalic acid mono-2-hydroxyethyl ester | 1.32 | 1.23 | 82.6 | 82.3 |
| 15 | Zinc salt of 4-chlorophthalic acid mono-2-hydroxyethyl ester | 1.31 | 1.18 | 82.7 | 81.4 |

TABLE 1-continued

| | Color developing material | Color density ($D_0$) | Color density after test for plasticizer resistance ($D_1$) | Whiteness before recording (%) | Whiteness after test for diazo resistance (%) |
|---|---|---|---|---|---|
| 16 | Zinc salt of 3,4,5,6-tetrachloro-phthalic acid mono-2,3-dihydroxy-propyl ester | 1.30 | 1.27 | 83.0 | 82.5 |
| Comp. Ex. | | | | | |
| 1 | Bisphenol A | 1.30 | 0.14 | 80.3 | 51.6 |
| 2 | Zinc salicylate | 1.29 | 0.73 | 52.0 | 49.8 |
| 3 | Zinc salt of phthalic acid mono-n-butyl ester | 0.37 | 0.11 | 83.0 | 82.9 |
| 4 | 3,4,5,6-tetrachlorophthalic acid mono-sec-butyl ester | 0.98 | 0.44 | 46.6 | 42.7 |

As seen from Table 1, the heat-sensitive recording papers of the present invention can produce images of high color density, thus have a high sensitivity and are suitable for high-speed recording, and are excellent in resistances to plasticizer and diazo developer, and therefore have high retentivity of the record image and whiteness of the background portion.

We claim:

1. A heat-sensitive recording material comprising a base sheet and a heat-sensitive record layer formed over the base sheet and comprising a colorless or pale-colored basic dye and a color developing material capable of forming a color when contacted with the dye, the heat-sensitive recording material being characterized in that the heat-sensitive record layer contains a color developing material comprising at least one multi-valent metal salt of a halophthalic acid derivative represented by the formula

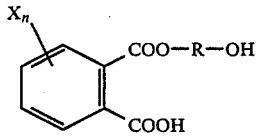

(I)

wherein R represents a divalent saturated or unsaturated $C_2$–$C_{12}$ aliphatic hydrocarbon group which may optionally have a hydroxyl, $C_1$–$C_3$ acyloxy or phenyl group as a substituent or a divalent saturated or unsaturated $C_4$–$C_6$ aliphatic hydrocarbon group containing one or two ether bonds, X is a halogen atom 1 and n is an integer of 1–4.

2. A heat-sensitive recording material as defined in claim 1 wherein the halophthalic acid derivative is represented by the formula

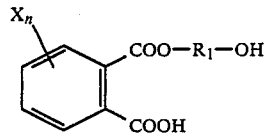

(II)

wherein $R_1$ is a divalent saturated $C_2$–$C_6$ aliphatic hydrocarbon group which may optionally have a hydroxyl, or acetoxy group as a substituent, or a divalent saturated $C_4$–$C_6$ aliphatic hydrocarbon group containing one or two ether bonds, X is a halogen atom and n is an integer of 1–4.

3. A heat-sensitive recording material as defined in claim 1 wherein n is 4.

4. A heat-sensitive recording material as defined in claim 1 wherein the multi-valent metal salt is magnesium salt, calcium salt, barium salt, zinc salt, aluminum salt, tin salt, iron salt, cobalt salt or nickel salt.

5. A heat-sensitive recording material as defined in claim 1 wherein the multi-valent metal salt is magnesium salt, calcium salt, barium salt or zinc salt.

6. A heat-sensitive recording material as defined in claim 1 wherein the multi-valent metal salt of halophthalic acid derivative is a zinc, magnesium, calcium or barium salt of a halophthalic acid derivative of the formula

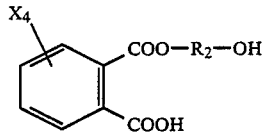

(III)

wherein $R_2$ is a branched- or straight-chain $C_2$–$C_6$ alkylene group which may optionally have a hydroxyl group or acetoxy group as a substituent, a cyclohexylene group, or a group —$CH_2CH_2OCH_2CH_2$— and X is fluorine, chlorine or bromine atom.

* * * * *